US006410098B1

(12) United States Patent
Seo et al.

(10) Patent No.: US 6,410,098 B1
(45) Date of Patent: Jun. 25, 2002

(54) PROCESS FOR PREPARING COPPER-FILM-PLATED STEEL CORD FOR VEHICLE TIRE

(75) Inventors: Gon Seo; Pyong Lee Cho; Gyung Soo Jeon, all of Chonnam; Seung Kyun Ryu, Seoul, all of (KR)

(73) Assignee: Digital Plating Co., Ltd., Seoul (KR)

( * ) Notice: Subject to any disclaimer, the term of this patent is extended or adjusted under 35 U.S.C. 154(b) by 0 days.

(21) Appl. No.: 09/610,183

(22) Filed: Jul. 5, 2000

(51) Int. Cl.[7] ..... B05D 1/38; B05D 3/12; B21C 1/02

(52) U.S. Cl. ..... 427/405; 427/328; 427/436; 427/434.6; 72/47; 72/274

(58) Field of Search ..... 427/305, 328, 427/405, 406, 436, 437, 434.5, 434.6; 72/47, 274

(56) References Cited

U.S. PATENT DOCUMENTS 2,002,261 A * 5/1935 Domm
4,883,722 A * 11/1989 Coppens et al. ..... 428/625

FOREIGN PATENT DOCUMENTS

JP 53-78937 A * 7/1978
JP 56-90963 A * 7/1981
JP 58-61297 A * 4/1983
JP 2-185982 A * 7/1990
JP 5-148660 A * 6/1993

OTHER PUBLICATIONS

[1] van Ooij, W. J., Rubber Chem. Technol. 52, 605 (1979).
[2] van Ooij, W. J., Rubber Chem. Technol. 57, 421 (1984).
[3] van Ooij, W. J., Rubber Chem. Technol. 51, 52 (1978).
[4] Hamed, G. R. and Huang, J., Rubber Chem. Technol. 64, 258 (1991).
[5] Jeon, G. S., Kim, Y. M. and Seo, G., HWAHAK KONGHAK 36, 179 (1998).
[9] Seo, G., J. Adhesion. Sci. Technol. 11, 1433 (1997).
[10] Jeon, G. S., Han, M. H. and Seo, G., Korean J. Chem. Eng. 16, 248 (1999).
[11] van Ooij, W. J., Giridhar, J. and Ahn, J. H., Kautsch. Gummi, Kunstst. 44, 348 (1991).
[14] van Ooij, W. J. Kautsch. Gummi, Kunstst. 30, 833 (1977). V.
[15] Pinkerton, H., Electroplating Engineering Handbook (Van Nostrand Reinhold Co., New York, 1986), 4th ed. Chap. 14, pp. 420–425).
[16] Durney, L. J., Electroplating Engineering Handbook (Van Nostrand Reinhold Co., New York, 1986), 4th ed. Chap. 14, pp. 321–325.
[17] Jeon, G. S., Cho, P. L. and Seo, G., J. Adhesion, (2000) (rec'd in final form Feb. 14, 2000).
[18] Jeon, G. S., Han, M. H. and Seo, G., J. Adhesion 69, 39 (1999).
[19] Jeon, G. S., Han, M. H. and Seo, G., J. Adhesion Sci. Technol. 13, 153 (1999).
[20] Jeon, G. S., Han, M. H. and Seo, G., Korean J. Chem. Eng. 15, 317 (1998).
[21] Gent, A. N., Rubber Chem. Technol. 56, 1011 (1983).
[22] Lievens, H., Kautsch. Gummi, Kunstst. 39, 122 (1986).

* cited by examiner

*Primary Examiner*—Michael Barr
(74) *Attorney, Agent, or Firm*—Maria Parrish Tungol

(57) ABSTRACT

A process is disclosed for preparing copper-film-plated steel cord suitable for use in vehicle tires comprising plating zinc or tin on the surface of steel cord, drawing the zinc or tin-plated cord, and then plating copper film onto the zinc or tin plated steel cord by contact with a solution of cupric sulfate solution, cupric nitrate, cupric chloride or cupric acetate. Compared with the presently used brass-plated steel cord, manufacturing tires with copper-plated cord according to the present invention reduces manufacturing time due to faster formation of adhesion interphase, increases the storage period by enhancing moisture stability, and retards adhesion degradation thereby extending the service life of the tires.

5 Claims, No Drawings

PROCESS FOR PREPARING COPPER-FILM-PLATED STEEL CORD FOR VEHICLE TIRE

BACKGROUND OF THE INVENTION

1. Field of Invention

The present invention relates to a process for preparing the copper film-plated (hereafter, called "copper-plated cord") cord and to a composition of rubber compound therefor. More particularly, the present invention relates to a process for preparing copper-plated cord of 20 to 90 nm of copper film for vehicle tire, by plating zinc or tin with strong tendency of ionization on the surface of steel cord and after drawing the zinc- or tin-plated cord, and then plating copper film onto it contacting to copper sulfate solution of 10 to 50 gram per liter.

2. Description of the Prior Art

Steel cords are inserted into the rubber compounds of the belt and carcass of a tire in order to sustain its heavy weight, to absorb properly impacts encountered during service, and to enhance its mechanical stability. Since steel cord does not adhere directly to a rubber compound, its surface has been plated with brass. Sulfur in the rubber compound reacts with copper of the brass forms a copper sulfate which is the most important material of the adhesion interphase, resulting a strong and stable adhesion between rubber bulk and steel cord. However, several reactions between brass and oxygen or coater are simultaneously carried out during curing, and thus, the adhesion interphase contains oxides and hydroxide of copper and zinc as well as copper sulfide. Adhesion is very important technology for manufacturing tire: a good adhesion between steel cord and rubber compound is essential for cord to keep the performance of tire from the impact during service. On the other hand, the adhesion is not easy, because their physical properties—rubber compound and steel cord—are markedly different.

Steel cord has been used for 50 years as a structure supporting material of tire, and its physical property steadily improved. Nowadays, high-tensile steel cord has been replaced by super-tensile one. However, the replacement of normal tensile one by high-tensile one is not exceeded over 10 years. On the contrary, brass has been consistently used as a plating material of steel cord because of its excellent processability and adhesion property. But the additional growth of copper sulfide and zinc oxide at the adhesion interphase during tire service, causes adhesion degradation. The heat generated from a tire during service and the contact with moisture and oxygen in the air accelerate the additional growth, bringing about inevitably adhesion degradation. In order to maintain an excellent adhesion property for a long service life of a tire, the copper content in brass and the plating weight of brass should be optimized in the manufacturing of brass-plated steel cord. At present, the copper content of brass is lowered to 63% and the plating weight of brass is also lowered to the level of 3.6 g per 1 kg of a steel cord. These changes aim to prevent excessive growths of copper sulfide and zinc oxide during service of tire by reducing the source materials of copper and zinc. The lowering of copper in the brass is also effective to reduce the reactivity of copper in the formation of copper sulfide.

Moreover, if the layer is thin during the formation of the brass layer by electroplating, the amount of the brass working as a solid lubricant reduces, thereby giving the bad effect to the wire break and surface roughness. The β-structured brass is formed when the Cu contents of brass layer is low. The β-structured brass has bad drawing property than α-structured brass, which gives bad effect to the cold drawing of wire. Thus, it is very difficult to low the copper content in brass layer of tire cord.

In addition, the composition of the rubber compound has been optimized to obtain a strong and stable adhesion: the cure rate of rubber is controlled regarding the formation rate of copper sulfide and diffusion rate of sulfur in bulk rubber. However, the improvement of the adhesion between rubber compound and brass-plated steel cord has not been satisfied, because the additional growth of the adhesion interphase is essentially inevitable. The further reduction of the plating weight of the brass is impossible due to the increase in the roughness of the brass surface generated at drawing step of the cord, because the bare surface of iron requires more work, producing non-even surface. Uneven plating of the brass causes heterogeneity in copper content, which brings about the insufficient growth of copper sulfide and poor adhesion.

In order to increase the adhesion stability of steel cord and rubber compound, the type and quantity of the additives such as the sulfur (vulcanizing agent), vulcanization promoter, adhesion promoter and filler must be optimized. Furthermore the condition of the vulcanization such as time and temperature, and the composition and thickness of the brass layer must be adjusted precisely.

Another attempt to enhance the adhesion property is by changing the order of plating material or adding the Co or Ni in the brass layer. And another way is to plate another material between substrate and brass layer, but productivity problems prevent the mass production of such products.

But the serious problem with brass as a plating material of the steel cord is overgrowths of copper sulfide and zinc oxide. Although copper sulfide is an essential material of an adhesive interphase and zinc oxide is helpful to control the formation rate of copper sulfide, excess growth brings about severe degradation of the adhesion interphase. The copper and zinc plated on the steel cord are heated by running tire and the heat accelerates reaction with the humidity and oxygen in the air, resulting in the further growth of copper sulfide and the further loss of metallic zinc. Since the contact between tire and humidity or air is inevitable, the adhesion degradation is not fundamentally inhibited when the brass is used as a plating material.

It is possible to use the brass-plated steel cord to enhance the stability of a tire by optimizing the brass composition and brass-plating weight, and by designing a proper rubber compound for it, however, these methods are limited in retarding the adhesion degradation. Since almost all of heavy duty tires such as truck and bus tires are reused by retreading them up to several times to save material waste, the reinforcement of tire structure by steel cord and the adhesion stability between the rubber compound and steel cord is considered more significant in order to enhance tire endurance. Accordingly, it is highly desireable to develop substitutes for brass as a plating material, which maintain adhesion interphase integrity strongly under severe service conditions of a tire for a long period of time.

Copper sulfide formed between the brass-plated steel cord and rubber compound acts as an adhesive, providing a strong and stable adhesion. On the contrary, copper sulfide formed between the copper plate and rubber compound does not exhibit any adhesive role. Overgrown copper sulfide is easily separated from the copper plate and then attaches to the rubber side, because the mechanical property of copper sulfide itself is very weak. However, it is previously known that an ultra-thin copper film onto a steel plate provides strong adhesion with a rubber compound. The obstacle to the application of copper film as an adhesive material is the difficulty in the commercial manufacture of the copper-plated cord with ultra-thin copper film. The exposure of a small part of bare iron and heterogeneous plating of copper causes a serious degradation in adhesion, thus, the use of copper as a plating material is not performed.

Plating an ultra-thin copper film on steel cord instead of a brass has several advantages sufficient formation of adhesion interphase, suppressing overgrowth, reduction of manufacturing time of a tire, and enhancement of the stability against the moisture and long-term storage due to the copper's better stability to moisture than brass. Furthermore sustaining adhesion interphase from dezincfication during salt solution aging is expected, because of absence of zinc element. However the advantages of copper-plated cords are diminished with uneven thickness of copper film due to the roughness of the steel rod; i.e., in parts where the copper is plated too thick, the adhesion will be poor because of the overgrowth of copper sulfide, and in parts where the copper is plated too thin, the exposed steel surface will lead to an easy rupture in the adhesion phase.

SUMMARY OF THE INVENTION

A process is disclosed for preparing a copper-film-plated steel filament comprising plating zinc or tin on the surface of a steel filament, drawing the zinc or tin-plated steel filament, and contacting the drawn zinc or tin-plated filament with a solution of cupric sulfate, cupric nitrate, cupric chloride, or cupric acetate to plate a copper film on the surface of the zinc or tin-plated steel filament. The copper-film-plated steel filament produced by the process according to the present invention comprises a steel filament, a layer of zinc or tin film on the surface of the steel filament, and a layer of a copper film on the surface of the layer of zinc or tin film. The copper-film-plated steel filaments according to the present invention are used to form steel cords for use in rubber articles such as tires.

It is an object of the invention to provide a process for preparing a copper-film-plated steel filament by plating copper film on the surface of the zinc or tin-plated steel filament to form a copper-film-plated steel filament. It is another object of the invention to provide a process of preparing steel cord suitable for use in tires by twisting a plurality of the copper-film-plated asteel filament together. It is a further object of the invention to provide rubber articles such as tires wherein the rubber articles contain steel cords comprising a plurality of copper-film-plated steel filaments according to the present invention.

Compared with the use of brass-plated steel cord, manufacturing tires with copper-plated cord according to the present invention reduces manufacturing time due to faster formation of adhesion interphase, increases the storage period by enhancing moisture stability, and retards adhesion degradation thereby extending the service life of the tires.

DESCRIPTION OF THE INVENTION

In the process of the invention, metallic zinc or tin is plated on the surface of a steel filament and the zinc or tin-plated filament is contacted with a solution of cupric sulfate, cupric nitrate, cupric chloride, or cupric acetate to plate a copper film on the surface of the zinc or tin-plated steel filament to form a copper-film plated steel filament having an outer layer of copper film. The concentration of cupric salt in the plating solution ranges from 10 to 50 gram per liter. The plating process is preferably carried out with vigorous circulation of the plating solution in the plating bath. The thickness of the zinc or tin plated on the steel filament ranges from 0.05 to 2.5 $\mu$m. The thickness of the copper film plated on the zinc or tin-plated steel filament ranges from 20 to 90 nm. The thickness of the copper film plated on the zinc or tin-plated steel filament preferably ranges from 30 to 70 nm.

The copper-film-plated steel filament may also be prepared by plating zinc or tin on the surface of a steel filament, drawing the zinc or tin-plated steel filament, twisting the zinc or tin plated filament, and contacting the drawn filament with a solution of cupric sulfate, cupric nitrate, cupric chloride, or cupric acetate to plate a copper film on the surface of the zinc or tin- plated steel filament.

The process of the present invention produces copper-film-plated steel filaments that are adherable to rubber. Steel cords suitable for use as tire reinforcing elements are produced from a plurality of copper-film-plated steel filaments. The thus produced steel cords are used in rubber articles such as tires. The rubber articles may additionally contain cobalt salt.

The process and products according to the present invention are further described in the following non-limiting examples.

EXAMPLES

Zinc of high ionization was plated on a large steel rod which was then drawn to minimize the roughness of the steel rod. Copper film was plated on the zinc-plated steel filament by a displacement plating method. The amounts of copper film were controlled by the changes of substitution plating times. Substitution plating method enabled copper to be plated from outer surface of steel cord. The thus prepared copper-plated cords were adhered to two different rubber compounds and their adhesion properties were investigated. Adhesion improvement of copper-plated cords was acheived with the addition of resin type adhesion promoters into a rubber compound. Copper-film-plated plates were also prepared and their adhesion properties were studied. The copper-film-plated plates had superior adhesion properties of copper film when compared to the adhesion properties brass film.

(1) The preparation of Copper-plated Cords

Metal zinc was plated on the surface of the drawn steel filament (high tensile, C content: 0.82%) of 0.25 mm diameter using electroplating method. After removing fatty acid from the zinc-plated ilaments by the treatment of 5% NaOH solution, copper was plated on the surface of the washed filaments by substitution plating method at 20° C. Copper content was ranged 17–20 g/lsolution as cupric sulfate. After washing the copper-film-plated filaments at 85° C. and drying them in 90° C. hot air, they were twisted together to be the copper-plated cords of 2+2×0.25 HT construction. The thickness of copper film was conirolied by changing the piafing time. at constant concentration of sulfuric copper acid. The average thickness of three different copper films measured by XRF were 32, 45, and 90 nm, respectively. Copper-film-plated cords were named as Cu( ) cord, with the thickness in nm being the number in the parentheses.

Brass-plated steel cord of 2+2×0.25 HT was also used for comparison, of which plating weight and composition were 4.2 g/kg and Cu/Zn=64/36, respectively.

(2) The Preparation of the Simplified Rubber Compound

The simplified rubber compound (here after abbreviated as "Rub-00") was prepared to clarify the differences in adhesion properties, therefore, bonding agents and silica were not added, and carbon black and anti-degradant were kept at minimum level. The master batch components were as follows; natural rubber (Lee Rubber Co., Malaysia, SMR-20), 100 phr; carbon black N351 (Lucky Co., Korea), 30 phr; aromatic processing oil (Michang Co., Korea, A#2), 5 phr; zinc oxide (Hanil Co., Korea), 10 phr; antioxidant (Monsanto Co., USA Kumanox-RD, 2,2,4-trimethyl-1,2-dihydroquinone), I phr; cobalt salt (Rhone Pouluenc Co., France, Manobond 680C), 2.0 phr. Final rubber compound components were as follows: masticated rubber masterbatch, 100 phr; stearic acid (Pyungwha Co., Korea), 1.5 phr; accelerator (Monsanto Co., USA, Santocure MOR, 2-(morpholinothio)-thio-benzothizole), 0.7 phr; insoluble sulfur (Akzo Co., The Netherlands, Crystex HS OT 20), 5.0 phr.

The rubber compounds were mixed following the procedures described in ASTM D-3184-91, using an internal mixer (Farrel co., USA, Banbury Mixer model 82). The masterbatch components were mixed for 5 min. at a rotor speed.of 40 rpm and dumped at 150° C. After the masterbatch compound was cooled down to room temperature, the final mixing components were mixed for 5 min. at a rotor speed of 30 rpm and dumped at 90° C. After dumping, the batches were sheeted out using a two-roll mill (Farrel co., model MKIII, USA).

(3) The Preparation of the Commercial Rubber Compound

The commercial rubber compound (here after abbreviated as "Rub-BP") was prepared with the addition of bonding promoters into the simplified rubber compound and the adhesion properties were investigated with copper-plated cords.

2.0 phr of RFR (resorcinol formaldehyde resin, Indespec., U.S.A) and 3.7 phr of HMMM (hexamethoxymethylmelamine, Sytec Co., U.S.A) were added into the master batch and final mixing of the simplified rubber compound, respectively. The mixing procedure of the commercial rubber compound was the same as that of simplified rubber compound.

(4) The Preparation and Evaluation of Adhesion Sample

By the procedure described in ASTM-D2229-91, specimens for T-test were cured at 160° C. on a cure press. Curing was maintained 7 min. longer than T90 time. For humidity aging, rubber samples and adhesion samples were placed in a humidity chamber (Weiss Technik., model 305B) for 5, 10, and 15 days under conditions of 85° C. and 85% relative humidity. Thermal aging was performed at 95° C. for 5, 10, and 15 days and salt solution aging at 25° C. NaCI solution for 5days.

Pullout force was determined as the maximum force exerted by the tensile tester (model 6021, Instron, USA) on a T-test adhesion sample during pullout test, with 100 mm/min. of crosshead speed. Rubber coverage was also noted. The rubber coverage which denoted the relative extent of rubber covered on the pulled out cord was determined by the naked eye with a 5% interval; bare steel cord as 0% to fully covered rubber as 100%. Each value reported was the average derived from six specimens.

(5) The Adhesion Properties of Copper-plated Cord with Simplified Rubber Compound Table I shows the adhesion properties between copper-plated cords and the simplified rubber compound before and after thermal aging.

TABLE I

The adhesion properties of copper-plated cords with the simplified rubber compound after thermal aging at 95° C.

| | Pullout force (N) | | | | Rubber coverage (%) | | | |
|---|---|---|---|---|---|---|---|---|
| | Aging period (day) | | | | | | | |
| Cord | 0 | 5 | 10 | 15 | 0 | 5 | 10 | 15 |
| Cu(32) | 332 | 282 | 279 | 273 | 45 | 45 | 50 | 55 |
| Cu(45) | 185 | 167 | 149 | 167 | 10 | 25 | 25 | 30 |
| Cu(90) | 140 | 158 | 145 | 124 | 0 | 10 | 5 | 10 |
| Brass | 589 | 425 | 375 | 335 | 100 | 100 | 100 | 95 |

The unaged and thermally-aged adhesion properties of copper-plated cords were inferior to those of the brass-plated cord. However, the adhesion properties of copper-plated cords were high when the copper film was thin. The unaged pull-out force of the Cu(32) cord, which had the thinnest copper film, was almost half of that of brass-plated cord; as was the rubber coverage of Cu(32) cord. Rubber coverage also became higher with the decrease in the thickness of copper film. Rubber coverage was found to be zero on the Cu(90) cord, but on the Cu(32) cord it was 45%, almost half of that of the brass-plated cord. Pull-out force and rubber coverage were better as the thickness of copper film decreased.

With an aging period, the adhesion properties of copper-plated and brass- is plated cord were all decreased, but the thermal adhesion stability was better with the decrease in the thickness of copper film; i.e., the pullout force of the thinnest copper film cord Cu(32) at 15 days after thermal aging was recorded 273 N, 82% of unaged force, and the rubber coverage was noted 55% which was rather higher than the unaged coverage 45%. On the other hand, the unaged pullout force of the brass-plated cord was as high as 589 N, but at 15 days after thermal aging it was reduced to 335 N, which was only 57% of unaged force. It is worth noting that in the unaged state the pullout force of Cu(32) cord was just a half of the brass-plated cord, but that of Cu(32) cord 15 days after thermal aging was the almost same as that of brass-plated cord, and the rubber coverage of brass-plated cord was slightly lowed during thermal aging, but that of Cu(32) was more improved.

The adhesion stability of copper-plated cords was also superior in humidity aging as shown in Table II.

TABLE II

Adhesion properties of the copper-plated cords with the simplified rubber compound after humidity aging.

| | Pullout force (N) | | | | Rubber coverage (%) | | | |
|---|---|---|---|---|---|---|---|---|
| | Aging period (day) | | | | | | | |
| Cord | 0 | 5 | 10 | 15 | 0 | 5 | 10 | 15 |
| Cu(32) | 332 | 242 | 253 | 245 | 45 | 50 | 55 | 35 |
| Cu(45) | 185 | 204 | 190 | 173 | 10 | 20 | 25 | 25 |
| Cu(90) | 140 | 125 | 149 | 138 | 0 | 0 | 5 | 10 |
| Brass | 589 | 240 | 202 | 193 | 100 | 40 | 60 | 25 |

Although the unaged adhesion properties of copper-plated cord were inferior to those of brass-plated cord, both pullout force and rubber coverage of Cu(32) cord after humidity aging for 15 days were all superior to those of brass-plated cord. The pull-out force of brass-plated cord was 193 N, whereas that of Cu(32) cord 273 N, and the rubber coverage of brass-plated cord was 25%, whereas that of Cu(32) cord 55%. With the humidity aging the pullout forces of both cords were decreased, but the degree of the decrease was lowered on the Cu(32) cord. Even though the rubber coverage of brass-plated cord was so much decreased with humidity aging, that of Cu(32) cord was rather improved.

The adhesion properties between the simplified rubber compound and the copper-plated cords were also stable during salt solution aging. The adhesion properties after salt solution aging for 5 days were tabulated in Table III.

TABLE III

Adhesion properties of the copper-plated steel cords with the simplified rubber compound after salt solution aging

| | Pullout force (N) | | Rubber coverage (%) | |
|---|---|---|---|---|
| | Aging Period (day) | | | |
| Cord | 0 | 5 | 0 | 5 |
| Cu(32) | 332 | 246 | 45 | 45 |
| Cu(45) | 185 | 145 | 10 | 5 |
| Cu(90) | 140 | 85 | 0 | 0 |
| Brass | 589 | 163 | 100 | 20 |

The adhesion properties after salt solution aging were greatly dependent on the copper film thickness, as were those after humidity and thermal aging. The pull-out force of the Cu(32) cord with the thinnest copper film after salt solution aging of 5 days was as low as 246 N compared with 332 N of the unaged force of; however, the rubber coverage of 45% was retained even after salt solution aging. On the other hand, the pull-out force of the brass-plated cord dropped from 589 to 163 N with salt solution aging, and the rubber coverage was reduced from 100% to 20%. Although the unaged adhesion properties of the brass-plated cord were better than any of the copper-plated cords, those 5 days after salt solution aging were considerably superior on the Cu(32 ) cord w ith a thin copper film.

(6) The Adhesion Properties of Copper-plated Cords with a Commercial Rubber Compound.

The adhesion properties between copper-plated cords and a commercial rubber compound (Rub-BP) containing cobalt salt and bonding promoter were investigated by T-test method. Their adhesion properties after thermal aging treatment at 95° C. were tabulated Table IV.

TABLE IV

The adhesion properties between copper-plated cords and the commercial rubber compound after thermal aging.

| | Pullout force (N) | | | | Rubber coverage (%) | | | |
|---|---|---|---|---|---|---|---|---|
| | Aging period(day) | | | | | | | |
| Cord | 0 | 5 | 10 | 15 | 0 | 5 | 10 | 15 |
| Cu(32) | 542 | 422 | 405 | 430 | 90 | 95 | 80 | 85 |
| Cu(45) | 346 | 340 | 340 | 334 | 50 | 40 | 45 | 45 |
| Cu(90) | 256 | 232 | 200 | 230 | 25 | 25 | 30 | 30 |
| Brass | 544 | 426 | 410 | 396 | 100 | 100 | 100 | 100 |

Even though the commercial rubber compound was designed for brass-plated cord, the unaged adhesion properties of copper-plated cords with a commercial rubber compound could be comparable with those of brass-plated cord. Pull-out force and rubber coverage of Cu(32) cord with the thinnest copper film were 542 N and 90%, respectively, sowing almost the same level as those of brass-plated cord. The degradation of adhesion properties was relatively low on copper-plated cords after thermal aging; therefore pull-out force of Cu(32) cord, the thinnest copper film, 15 days after thermal aging was 430 N, indicating higher than 396 N of brass-plated cord. Unaged pull-out force and rubber coverage of Cu(45) and Cu(90) with relatively thick copper film were inferior to those of brass-plated cord, however the additional degradation with thermal treatment was relatively low on copper-plated cords.

On the other hand, the pull-out force of Cu(32) cord 15 days after humidity aging was 325 N, retaining 60% of that of unaged force, that of brass-plated cord was 226 N, 42% of unaged, being reduced more severely. At unaged state, rubber coverage of Cu(32) cord after humidity aging was 90% which is lower than 100% of brass-plated cord, but 15 days after humidity aging, 60% of Cu(32) cord was higher than 50% of brass-plated cord as shown Table V. Although the pull-out force and rubber coverage of all the cords become lowered, the degree of degradation was relatively low on copper-plated cords; therefore, adhesion stability of copper-plated cords against humidity aging was better than that of brass-plated cord.

TABLE V

The adhesion properties between copper-plated cords and a commercial rubber compound after humidity aging.

| | Pullout force (N) | | | | Rubber coverage (%) | | | |
|---|---|---|---|---|---|---|---|---|
| | Aging period(day) | | | | | | | |
| Cord | 0 | 5 | 10 | 15 | 0 | 5 | 10 | 15 |
| Cu(32) | 542 | 486 | 384 | 325 | 90 | 80 | 85 | 60 |
| Cu(45) | 346 | 348 | 300 | 247 | 50 | 40 | 45 | 35 |
| Cu(90) | 256 | 238 | 230 | 132 | 25 | 40 | 40 | 25 |
| Brass | 544 | 362 | 254 | 226 | 100 | 70 | 65 | 50 |

After salt solution aging treatment, the pull-out force of Cu(32) cord was similar to that of brass-plated cord, and rubber coverage was slightly low; therefore adhesion stability of a commercial rubber with copper-plated cords against salt solution aging was comparable to that of brass-plated cord. (see Table VI)

TABLE VI

The adhesion properties between copper-plated cords and the commercial rubber compound after salt solution aging.

| | Pullout force (N) | | Rubber coverage (%) | |
|---|---|---|---|---|
| | Aging Period(day) | | | |
| Cord | 0 | 5 | 0 | 5 |
| Cu(32) | 542 | 389 | 90 | 75 |
| Cu(45) | 346 | 336 | 50 | 45 |
| Cu(90) | 256 | 124 | 25 | 10 |
| Brass | 544 | 388 | 100 | 85 |

7. The Preparation of Copper Film-plated Plate

The surface of iron plate of 100 mm long, 32 mm wide, 0.4 mm thick was ground with sandpaper of 4000 mesh and cleaned by dipping it into acetone for 2~5min. to remove grease and other contaminants. After getting rid of oxide layer formed on surface by treating with 5% sulphuric acid for 60 sec., zinc was plated onto it in zinc sulfate solution of 20 g/L for 40 sec. using electoplating. Subsequently, copper was coated on the surface of zinc-plated plate by contacting a copper sulfate solution of 2.5 g/L and dipped into anhydrous methanol for 30 sec. to suppress the formation of oxide film by removing water. The thickness of the copper film was controlled by changing the contact time of the zinc-plated plate at constant copper sulfate solution. The thickness of copper for the copper-plated plates measured by the XRF (X-ray fluorescence) were 30, 65, 90 nm. Copper-plated were named as Cu( ) plate, with the thickness in ni being the number in the parentheses.

8. The Adhesion Properties of Copper-plated Plate

Adhesion properties of copper-plated plates with the rubber compounds were evaluated by pad-test method. The copper-plated plates of 0.4 mm thick were inserted between rubber pads of 2 mm thick, and they were cured at 150° C. and 13 MPa on a cure press. Curing was maintained for 3 min longer than $t_{90}$ time to compensate for heat transfer; therefore, Rub-00 rubber was cured for 11 min and Rub-BP rubber, to which resin type bonding promoters added, was cured for 17 min. In order to investigate the influence of cure condition, adhesion specimens of Rub-BP rubber were also prepared at undercure and overcure condition, curing for 8 min about 60% of $t_{90}$ time, and 45 min about 350% of $t_{90}$ time, respectively.

Peeling force was determined as the maximum force exerted by the tensile tester (Inston model 6021, USA) on a peel-test adhesion sample while peeling-out test at 300 mm $min^{-1}$ of crosshead speed. Each value reported was the average derived from five specimens.

The adhesion properties were investigated adhering Rub-00 and Rub-BP rubber to copper-plated plates of different amounts of copper film. As shown in Table VII, peeling forces of copper-plated plates and brass-plate adhered to Rub-00 rubber with no bonding promoters were not high and almost same between them. Rub-BP rubber containing bonding promoters showed greatly strong adhesions to copper-plated plates and brass-plate compared to Rub-00 rubber though they were dependent on the cure conditions. Although adhesion properties are mainly determined by the property of metal plate, they are also dependent on physical properties of a rubber compound. It is considered that strong adhesion of Rub-BP rubber is attributed to the high degree of crosslinking density by the addition of cobalt salt and the increased modulus by resin type bonding promoter. Adhesion strengths are different from cure conditions. At undercure condition, peeling force of brass-plate is better than those of copper-plated plates, however, at normal and overcure condition, peeling forces of copper-plated plates are superior. Cu(65) and Cu(90) plate, the plating thickness of which are in the range of 65~90 nrm, exhibited superior peeling forces to Cu(30) of thin copper film. Whereas the copper-plated cords showed the better adhesion as their thickness of copper film was lowered, among the copper-plated plates, Cu(90) plate of thick copper film showed the best adhesion. Differently from the copper-plated cord, copper-plated plate is unable to be drawn after plating zinc; thus remaining deep troughs generated from grinding the surfaces of the plate. So troughs are observed even at the copper- plated plates of relatively thick copper film. Especially superior adhesion of Cu(90) plate could be attributed to the relatively uniform plating of copper on the plate.

TABLE VII

Adhesion properties of rubber compounds with copper-plated plates manufactured under different cure conditions.

| Rubber compound | Cure time (min) | Copper film coated plate | Peeling force (N) |
|---|---|---|---|
| Com-00 | normal-cure [11 min] | Cu(30) | 44 |
| | | Cu(60) | 46 |
| | | Cu(90) | 49 |
| | | Brass | 56 |
| Com-BP | undecure [8 min] | Cu(30) | 46 |
| | | Cu(60) | 84 |
| | | Cu(90) | 78 |
| | | Brass | 180 |
| | normal-cure [17 min] | Cu(30) | 142 |
| | | Cu(60) | 397 |
| | | Cu(90) | 447 |
| | | Brass | 96 |
| | over-cure [45 min] | Cu(30) | 59 |
| | | Cu(60) | 231 |
| | | Cu(90) | 294 |
| | | Brass | 98 |

Copper is more stable to moisture than brass. Differently from brass-plate, since copper-plated plates has no zinc to readily erupt by moisture, it is expected that the degree of degradation in their adhesions is relatively low due to no change of adhesion interphase by exposure to moisture. In order to evaluate the stability of copper-plated plates on moisture, they were placed in a humidity chamber (Weiss Technik, model 305B) for 6 days under conditions of 60° C. and 65% relative humidity. The green humidity aged copper-plated plates were attached to Rub-BP rubber and cured for 17 min on a cure press as well as brass-plate. (see Table VIII)

TABLE VIII

Adhesion properties of copper-plated plates after green humidity aging prior to curing

| | Peeling force (N) | | | |
|---|---|---|---|---|
| Treatment □ Plate | Cu(30) | Cu(65) | Cu(90) | Brass |
| Unaged | 142 | 397 | 447 | 96 |
| Green-humidity aging | 33 | 119 | 208 | 58 |

The peeling forces of copper-plated plates were lowered with green humidity aging compared with those of no green humidity aging treatment. However, peeling force of Cu(65) and Cu(90) plate is superior to that of brass-plate, meaning that the adhesion properties is decreased with the change of adhesion interphase by mosture, but durability against green humidity aging is superior because of a high stability of copper-plated plate against moisture.

The method of process of preparing copper-film-plated steel cord by plating copper upon the surface of zinc plated steel cord was illustrated in the above detailed description. The example of using tin instead of zinc is omitted because it could be readily implemented by those having an art in this field. Using the solution of sulfuric copper acid was also exemplified for substitution plating method, however nitric copper acid, hydrochloric copper acid, or acetic copper acid instead of sulfuric copper acid can be used for substitution plating.

As the invention described above in detail, within the limit of uniform plating, 1) the adhesion properties were better as the thickness of copper film was decreased, 2) copper-plated cord was very stable against humidity and salt solution aging compared with brass-plated cord, 3) the adhesion properties of copper-plated cord were much dependent on the composition of rubber compound, 4) the unaged adhesion properties of copper-plated cord with the rubber compound containing cobalt salt and resin type bonding promoter was similar to those of brass-plated cord, 5) the adhesion properties of copper-plated cord could exceed those of brass-plated cord by optimizing the cure condition and the composition of a rubber compound.

Manufacturing a tire using copper-plated cord described in the invention instead of brass-plated cord enables to reduce cure time by rapid forming of adhesion interphase, to extend storage period by improving stability against moisture, and to retard adhesion degradation.

What is claimed is:

1. A process for preparing a copper-film-plated steel filment comprising plating ti on the surface of a steel filarnent, draang the tin-plated steel filament, and contacting the drawn tin-plated filament with a solution of cuprin sulfate, cupric nitrate, cupric chloride, or cupric acetate to plate a copper film on the surface of the tin-plated steel filament to form a copper-film plated steel filament having an outer layer of copper film.

2. A process for preparing a copper-film-plated steel filament according to claim 1, wherein the thickness of the copper film plated on the tin-plated steel filament is 20 to 90 nm.

3. A process for preparing a copper-film-plated steel filament according to claim 2, whereln the thickness of the copper film plated on the tin-plated steel filamenlt is 90 nm.

4. A process for preparing a copper-film-plated steel filament according to claim 2, wherein the thickness of the copper filmn plated on the tin-plated steel filament is 30 to 70 nm.

5. A process for preparing a copper-film-plated steel filament according to claim 4, wherein the thickness of the copper film plated on the tin-plated steel filament is 32 nm.

* * * * *